US005370394A

United States Patent [19]

Huncaga

[11] Patent Number: 5,370,394

[45] Date of Patent: Dec. 6, 1994

[54] MEANS FOR PLAYING GAMES OF PATIENCE

[76] Inventor: Gerhard Huncaga, uL. M. Hattalu 2048/2, CS 02601 DoLný Kubín, Czechoslovakia

[21] Appl. No.: 30,162

[22] PCT Filed: Mar. 4, 1992

[86] PCT No.: PCT/CS92/00006

§ 371 Date: Mar. 26, 1993

§ 102(e) Date: Mar. 26, 1993

[87] PCT Pub. No.: WO92/15380

PCT Pub. Date: Sep. 17, 1992

[30] Foreign Application Priority Data

Mar. 5, 1991 [DE] Germany ..... 4106896

[51] Int. Cl.[5] ..... A63F 9/08

[52] U.S. Cl. ..... 273/153 S; 273/155

[58] Field of Search ..... 273/153 R, 153 S, 155

[56] References Cited

U.S. PATENT DOCUMENTS

| | | | |
|---|---|---|---|
| 3,596,380 | 8/1971 | Williams | 273/155 |
| 4,468,033 | 8/1984 | Minami et al. | 273/153 S |
| 4,708,345 | 11/1987 | Ayers | 273/155 |
| 4,752,074 | 6/1988 | Juang | 273/155 |
| 4,868,506 | 9/1989 | Wiggs et al. | 273/155 |
| 4,881,738 | 11/1989 | Ayers | 273/155 |

FOREIGN PATENT DOCUMENTS

| | | | |
|---|---|---|---|
| 0322085 | 6/1989 | European Pat. Off. . | |
| 3821297 | 12/1989 | Germany . | |
| 4134718 | 4/1993 | Germany | 273/155 |
| 8805679 | 8/1988 | WIPO . | |

*Primary Examiner*—Vincent Millin
*Assistant Examiner*—Steven B. Wong
*Attorney, Agent, or Firm*—Speckman, Pauley & Fejer

[57] ABSTRACT

A game of patience including two coaxial mutually facing recesses rotatable about a common axis relative to one another including rings or disks comprising elements mounted therein. At lease one relative position of the rings or disks in relation to one another two opposite rebates jointly define accommodation for a pair of elements having two elements. The pair of elements is rotatable by at least one operating means to transfer the elements respectively into the other ring or disk.

25 Claims, 5 Drawing Sheets

MEANS FOR PLAYING GAMES OF PATIENCE

BACKGROUND OF THE INVENTION

Means for playing games of patience are known and have been described, for example, in German Patent Reference DE 38 21 297. In that case, the game of patience comprises two mutually rotatable half shells, mounted on a common axis. Each half shell comprises four clipped in segments, which may be of different colors and which carry at both ends different information symbols. Each half shell has four semi-circular apertures in each of which two rotary segments are mounted pivotally as quarter segments. When turning the half shell, the former may engage in such a manner that the rotary segments of both half shells occupy the same position. Thereby, it is possible to turn the rotary segments from one half shell into the other. This results in an engagement position of the rotary segments, permitting turning of the half shells. Turning of the half shells causes two rotary segments at a time to be displaced by 90° or a multiple thereof. The rotary segments carry different information contents, giving rise to a plurality of combination possibilities. It is a disadvantage of such known game of patience that each rotary segment must be operated individually, as a result, the game of patience can be solved with minimal mental effort.

SUMMARY OF THE INVENTION

Based on the aforesaid state of the art, it is an object of this invention to create a means for playing a game of patience, providing for degrees of difficulty to be adjusted according to requirements, such that many play variations are attainable, which can only be solved with a high degree of mental effort.

The stated object is attained with a game of patience having two coaxial recesses rotatable relative to one another about a common axis with rings or disks having elements supported therein, wherein in at least one relative position of the rings or disks relative to one another two mutually opposing recesses together accommodate a pair of elements. The elements can be rotated whereby the elements are transferred into a respective ring or disk.

The crux of this invention relates to the two disks or rings with recesses into which the elements can be inserted and can be rotated about radial axes and can thereby be transferred from one ring to the other. The degree of difficulty of the game of patience of this invention depends on one hand on the number of pairs of elements and on the other hand on how many pairs of elements can be rotated simultaneously relative to one another. A further feature of the game of patience of this invention resides in that no indication is given how many steps have already been performed in order to progress from the starting position to the finished position.

The game of patience is so operated that the mutually rotatable rings are always so turned that two elements at a time form a pair of elements that co-act with the operating means. When operating the game of patience, a desired number of element pairs may be mutually rotated depending on requirements, more particularly by 180°. This causes the element provided in one ring to be transported into the second ring, while the element accommodated in the second ring is transferred into the first ring. As the number of simultaneously rotatable element pairs is increased, the degree of difficulty of the game of patience is increased. Simple conversion of the operating means determines how many element pairs will be rotated by the operating means. In doing so the user may operate the operating means with his thumb.

BRIEF DESCRIPTION OF THE DRAWINGS

A preferred embodiment of the invention is diagrammatically illustrated in the drawing, and will be further explained, wherein.

DESCRIPTION OF PREFERRED EMBODIMENTS

Figure 1:
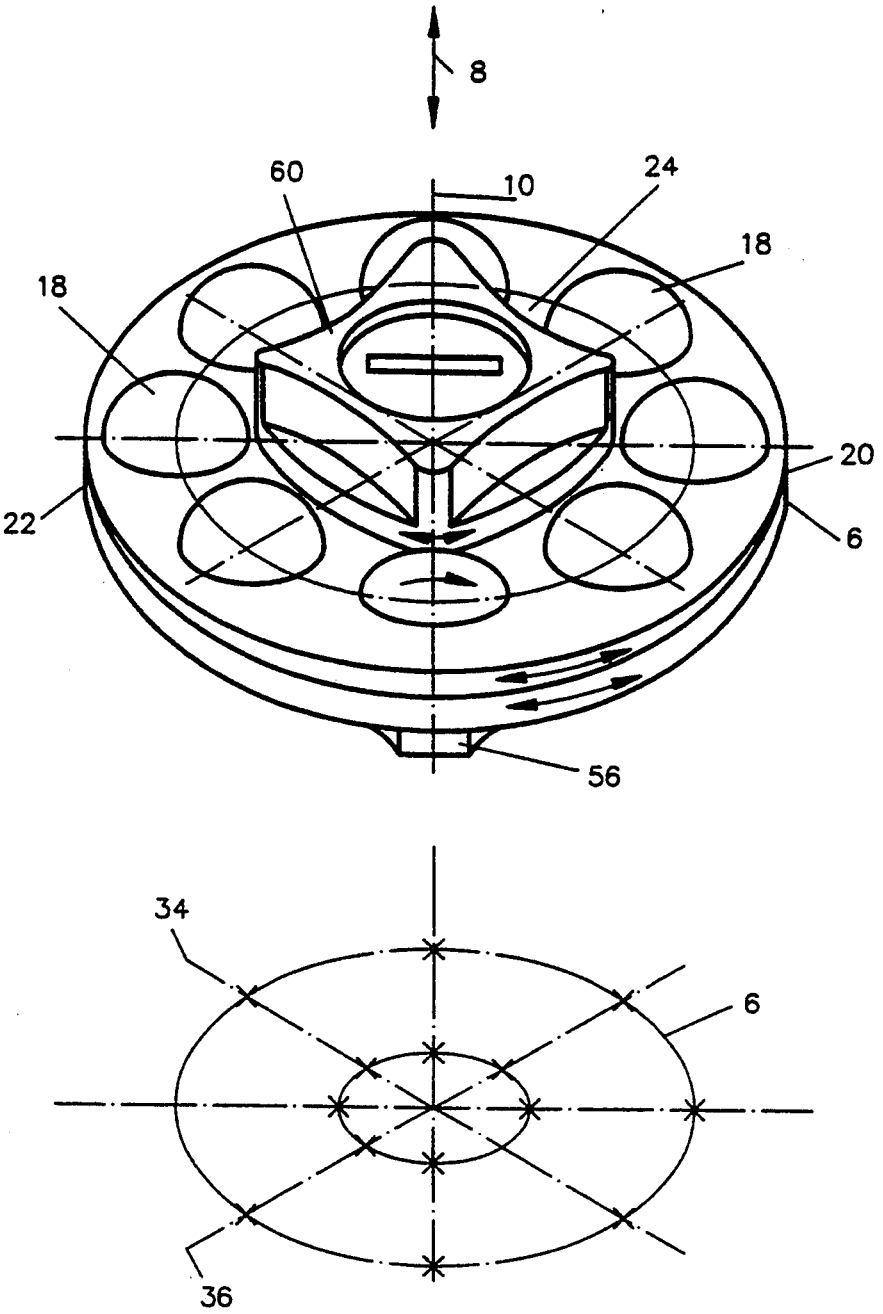
FIG. 1 shows an apparatus for playing a game of patience in perspective side view.
Figure 2:
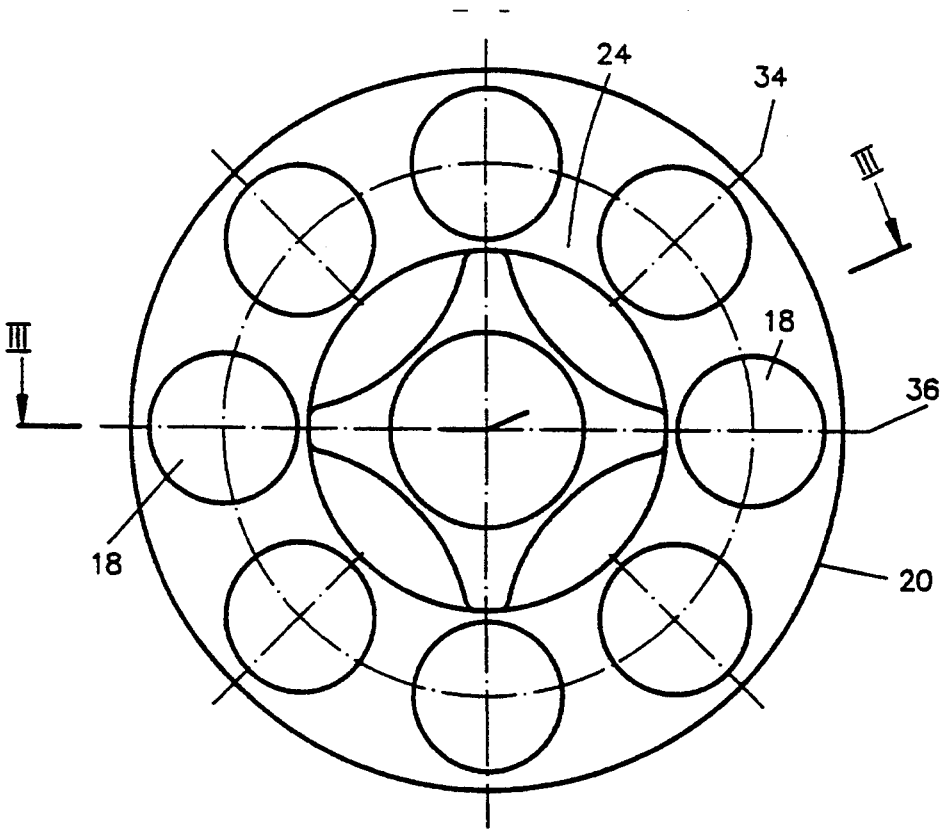
FIG. 2 shows the apparatus illustrated in FIG. 1 in vertical plan view.

In the drawings a means for playing a game of patience is shown, comprising two coaxial recesses 12, 14 facing each other and rotatable about a common axis 10, carrying rings 20 and 22 having elements 16, 18 mounted therein. In a plurality of relative positions of the rings 20 and 22, two mutually opposing and coaxial recesses 12 and 14 define a pair of elements 16, 18, each comprising two elements 16 and 18, such pair being rotatable by the operating means 24, whereby the elements 16 and 18 are transferred into the respective other ring 20 and 22. Each ring 20 and 22 has eight recesses 12 and 14 uniformly distributed about the axis 10. All of the rings are identically designed so that the rings 20 and 22 are interchangeable within the means for playing the game of patience.

Figure 5:
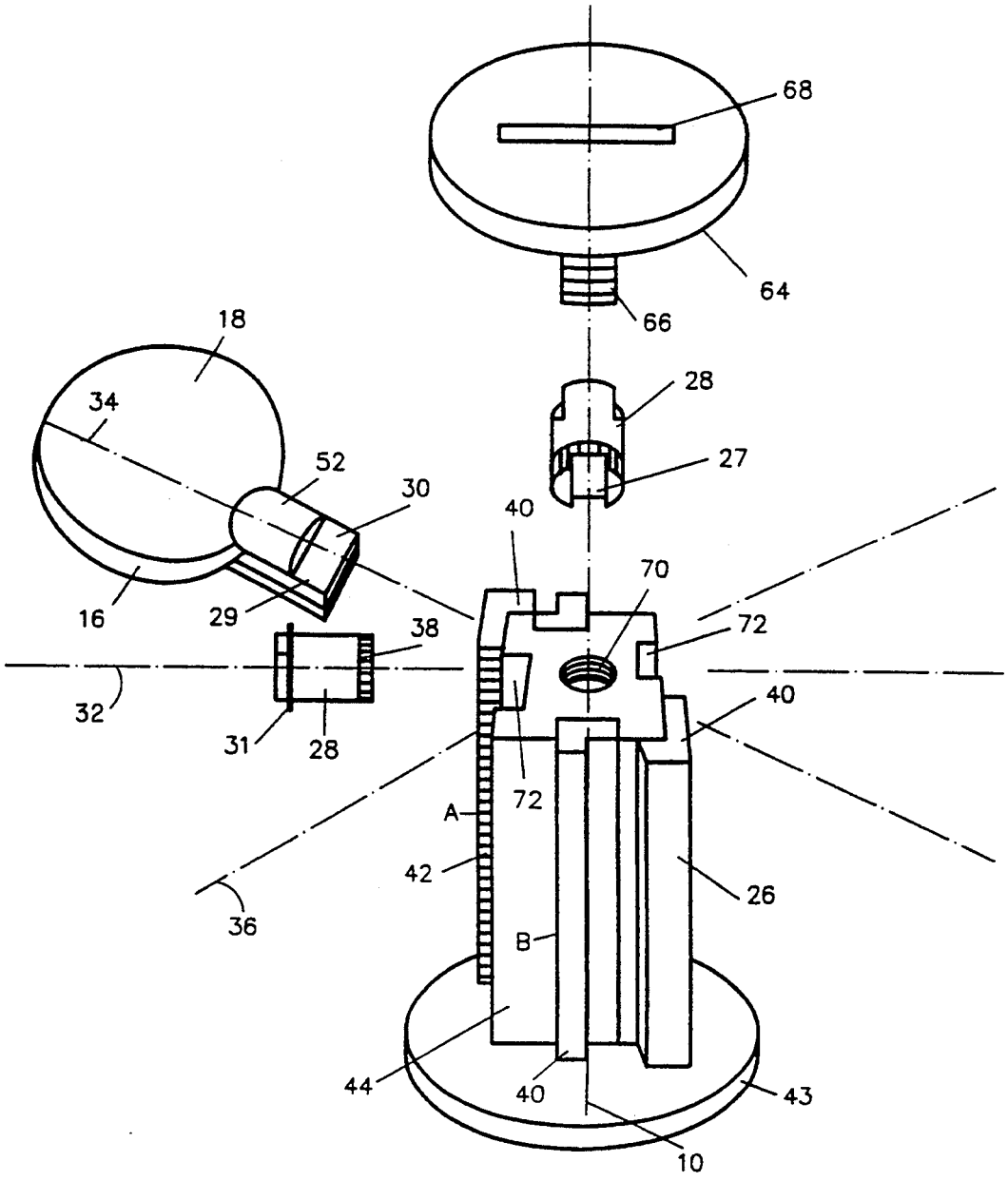
FIG. 5 shows the essential parts of the operating means in an exploded perspective view.

The operating means 24 comprise a manually operated body 26 co-acting with one or more coupling members 28. The coupling members 28 are provided coaxially to the pairs of elements 16, 18 and are rotatable about the same axes 32, 34 and 36. Furthermore the drawings indicate that the elements 16 and 18, being of the same shapes, are radially arranged and comprise means 30 which co-act with the operating body 26 and which have the form of projections, and are rotatable about the axis 32, 34 and 36. The operating body 26 is adjustable along a direction of the axis 10, is essentially block shaped and comprises in its external wall four axially directed recesses 72 of rectangular cross-section, into each of which a tooth rack 40 with teeth 42 can be inserted. In this context the tooth racks 40 can occupy active and inactive operational positions. The position of the tooth rack 40 denoted in FIG. 5 as A represents its active operating position whereas the position denoted by B of the tooth rack 40 which is accommodated in the recess 72 represents an inactive operating position. The tooth racks 40 have a substantially L-shaped profile and in their active state are supported against the vertically extending outer edges of the basic body 44. In this context the teeth 42 are provided outside of the associated recesses 72 while in the inactive operating state (position B) they are accommodated inside the recess 72. The tooth rack 40 is carried along when the operating body 26 is moved and engages with the corresponding pinion 38 of the coupling member 28.

Figure 3:
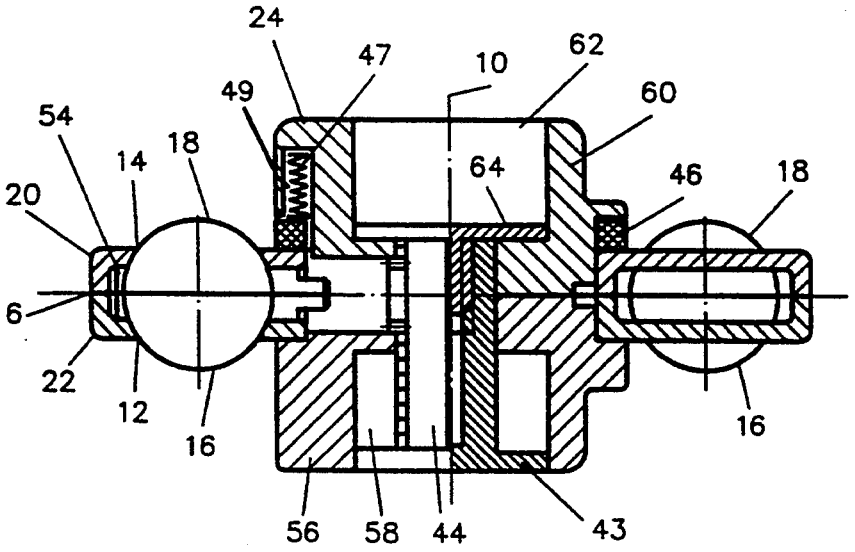
FIG. 3 shows a section taken along the line III—III shown in FIG. 2.
Figure 4:
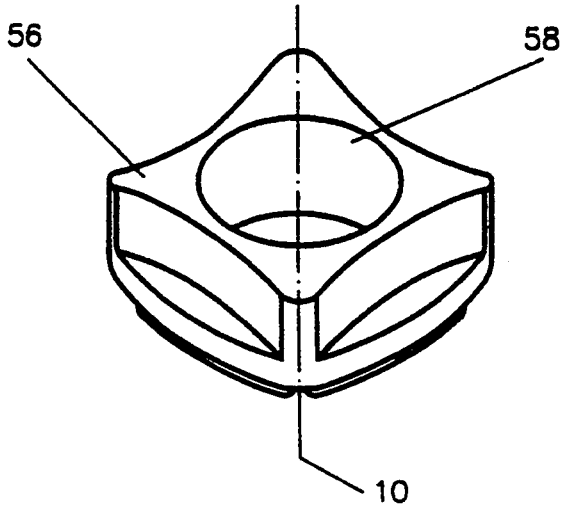
FIG. 4 shows a part of the operating means and the upper ring, in perspective side view.
Figure 4:
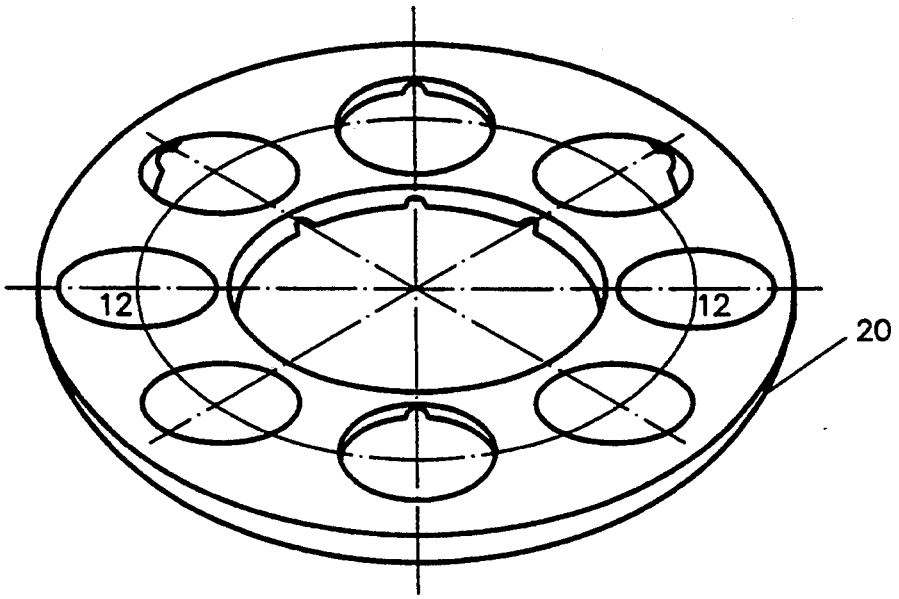

The operating means 24 comprises a catch 56, and co-acting member 60 and the operating body 26 accommodated inside thereof. The catch 56 as well as the co-acting member 60 each comprise a recess 58 and 62, respectively, connected in communication with one another inside which the operating body 26 is accommodated. The axial length of the operating body 26 is less than the inside height of the aperture formed in and passing through the operating means 24. The operating body 26 comprises, as shown in FIG. 3, the basic body 44 which in its lower region comprises a circular and disk shaped head 43, whereas its opposite end comprises a threaded passage 70 into which a closure screw 64 having a thread 66 may be screwed. For ease of operation of the closure screw 64 a transversely extending slot 68 is formed such that the closure screw 64 can be operated by means of a screwdriver, for example. The essentially block shaped basic body 44 is operationally connectable to the four tooth racks 40 which can occupy an active operating position (position A) and an inactive operating position (position B). The longitudinally extending inner edge of the two limbs of the tooth rack 40 for this purpose is supported against one of the longitudinally extending outer edges of the basic body 26. In the inactive state on the other hand (see position B) the longer one of the limbs, comprising the teeth 42, is completely accommodated inside the recess 72, such that it cannot co-operate with any pinion 38 of the coupling member 28. In the operating position of the means for playing a game of patience according to this invention, the basic body 26 carries at least one tooth rack 40; however, it is also possible for two, three or four tooth racks 40 to be provided. Of course it is also possible to design the basic body 26 as an elongated body having the cross-section of an equilateral polygon having a plurality of sides. By the number of the tooth racks 40 and the number of simultaneously actuateable pairs of elements 16, 18 the degree of difficulty of the game of patience is increased. It is up to the user to modify the degree of difficulty of the game of patience by fitting the basic body 26 with an appropriate number of tooth racks 40.

Figure 6:
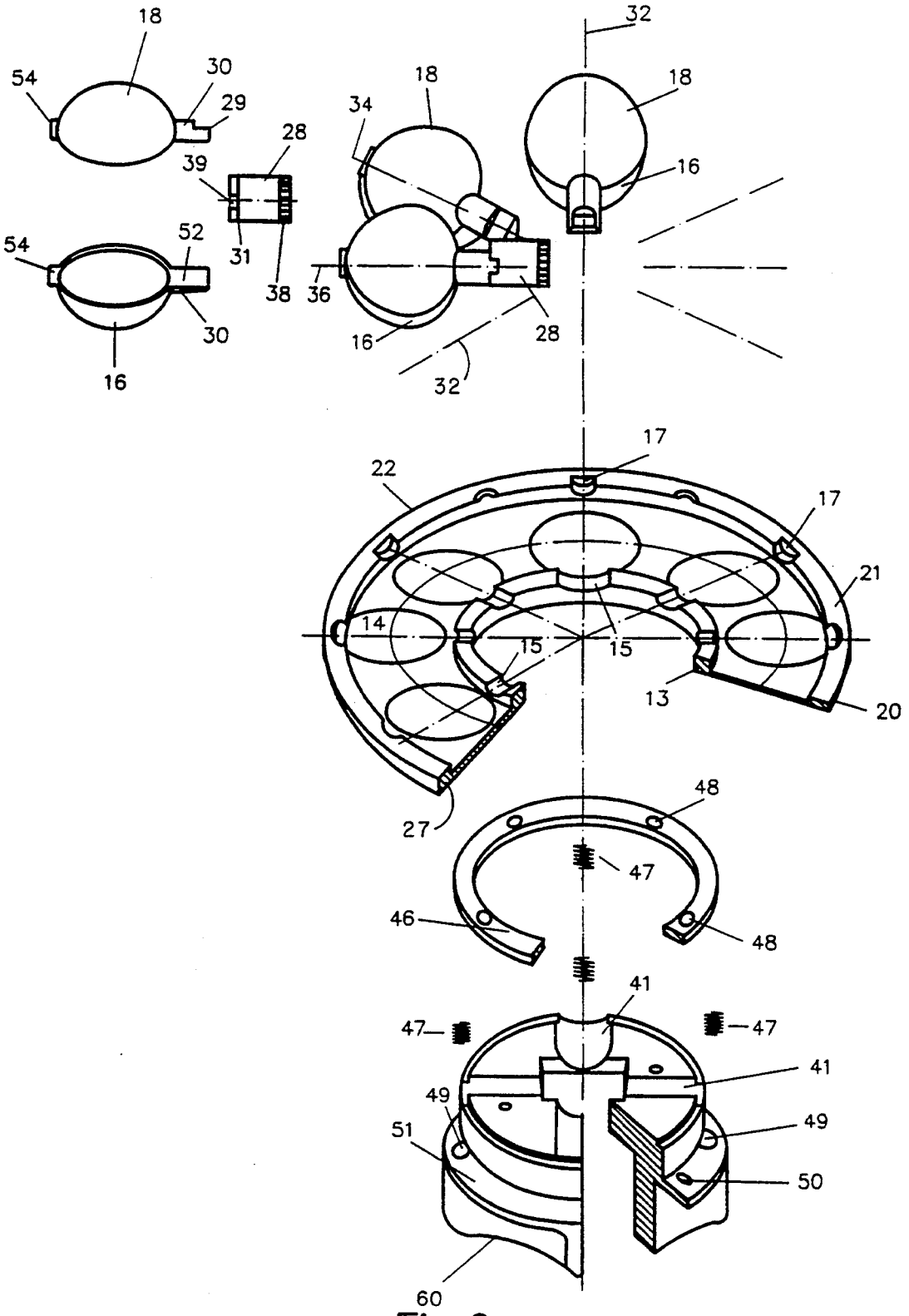
FIG. 6 shows a part of the means for playing a game of patience illustrated in FIG. 1 in a partial cross-sectional exploded perspective view.

The element pairs 16, 18 (see in particular FIG. 3, 5, 6) each define a common means 30 in the form of a mounting pin 52 with a lug 29. In the operating state of the game of patience the common lug 29 is in active engagement with the groove 39 which in turn forms part of the coupling member 28. Along the axis 34 and the opposite side of the hemispherical elements 16 and 18 mounting pins 54 are provided which are mounted in bearing recesses 17 (see FIG. 6) whereas the bearing pins 52 are mounted in bearing recesses 15. As will be seen in particular in FIG. 6, the ring 22 comprises an external collar 27 in which the bearing recesses 17 are formed and an inner collar 13 in which the bearing rebates 15 are formed.

The coupling members 28 are mounted in bearing recesses 41 of the catch 56 and the co-acting member 60. In order to prevent axial displacement of the coupling member 28 it comprises a flange 31 which is mounted in a groove (not shown) of the catch 56 and the co-acting member 60. The co-acting member 60 (see FIG. 6) further comprises recesses 49 for spring elements 47 and catch projections 50 which are adapted to engage into recesses 48 of complementary shape in a pressure ring 46. The spring loaded pressure ring 46 serves to permit the reliable setting of the individual operating positions of the game of patience according to this invention.

In the assembled condition of the means for playing the game of patience of this invention and in its starting position (see FIGS. 1 and 3) two recesses 12 and 14 co-act to form a common recess for a pair of elements 16, 18. For that purpose the operating body 26 is in one of its two terminal positions such that the grooves 39 of the coupling member 28 lie in the plane 6 of rotation. The rings 20 and 22 may be turned mutually in the direction of the double arrow (see FIG. 1), more particularly in such a manner that the upper elements 18 become associated with new elements 16. New recesses are thereby formed by new elements 16 positioned in recesses 12. If the operating body 24 is now displaced, e.g., from its lower position illustrated in FIG. 3, upwardly in the direction of the double arrow 8, those coupling members 28 which co-act with tooth racks 40 will be rotated by 180°, whereby the upper elements 18 are transferred into the lower ring 22 and the lower elements 16 are transferred into the upper ring 20. This causes the element pairs 16, 18 to revolve about the axes 32, 34 and 36. The rings 20 and 22 may now once again be rotated in relation to one another so that new element pairs 16, 18 are defined, and the adjustment procedure of the operating means 26 is repeated. The game of patience illustrated in FIGS. 1 to 6 comprises altogether eight element pairs 16, 18 each defining a sphere, all elements 16, 18 being of identical geometry, although only two elements 16, 18 at a time are of identical appearance (they may have the same color, for example). Thus, the game of patience provides in the starting position eight spheres (element pairs 16, 18) which differ, however, only in color. By rotating the rings 20 and 22 relative to one another and displacing the operating means, 26 new color combinations of pairs of elements 16, 18 are attained such that e.g., the upper element is red whereas the lower element of an element pair 16, 18 is green. It is thus the given tasks to operate the elements 16 and 18 in such a manner that they resume their original positions.

The means for playing the game of patience is preferably constructed of injection molded plastics.

I claim:

1. A game of patience comprising: two rings (20, 22) forming two coaxial mutually facing recesses (12, 14) rotatable relative to one another about a common axis (10), the rings (20, 22) having two elements (16, 18) supported within the recesses (12, 14), in at least one relative position of the rings (20, 22) two of the mutually opposing recesses (12, 14) are aligned with one another and accommodate a pair of the elements (16, 18), operating means (24) for rotating the elements (16, 18) relative to one another whereby the elements (16, 18) are transferred respectively into the other ring, and the operating means (24) comprising a manually operable operating body (26) which co-operates with a coupling member (28) adapted for engagement with at least one pair of the elements (16, 18).

2. A game of patience according to claim 1 wherein the rings (20, 22) each comprise at least three of the recesses (12, 14).

3. A game of patience according to claim 2 wherein mutually facing sides of the rings (20, 22) are planar and operatively interconnectable.

4. A game of patience according to claim 3 wherein the operating means (24) comprise a manually operable operating body (26) which co-operates with a coupling member (28) adapted for engagement with at least one pair of the elements (16, 18).

5. A game of patience according to claim 4 wherein the rings (20, 22) are of the same configurations and the recesses (12, 14) are uniformly distributed about the axis (10), and the elements (16, 18) comprise radially directed means (30) for co-acting with the operating means (24).

6. A game of patience according to claim 5 wherein the radially directed means (30) comprise projections which co-act with the operating means (24) by way of the coupling members (28) which are rotatable about a plurality of corresponding radial axes (32, 34, 36).

7. A game of patience according to claim 6 wherein the operating means (24) are adjustable along a direction of the axis (10).

8. A game of patience according to claim 7 wherein the coupling members (28) comprise a plurality of pinions (38) which co-act with a plurality of axially extending tooth racks (40) of the operating means (24).

9. A game of patience according to claim 8 wherein the tooth racks (40) having the operating means (24) are adjustable between an active operating position and an inactive operating position.

10. A game of patience according to claim 9 wherein a spring loaded pressure ring (46) having recesses (48) co-act with a plurality of engagement projections (50) of the operating means (24).

11. A game of patience according to claim 10 wherein the elements (16, 18) each have a form of a hemisphere.

12. A game of patience according to claim 11 wherein the respective pairs of elements (16, 18) define a hollow body.

13. A game of patience according to claim 12 wherein the elements (16, 18) are mounting pins (52, 54) which are radially directed, facing away from one another and mounted in the rings (20, 22).

14. A game of patience according to claim 13 wherein the mounting pins (52, 54) are provided between the rings (20, 22).

15. A game of patience according to claim 1 wherein mutually facing sides of the rings (20, 22) are planar and operatively interconnectable.

16. A game of patience according to claim 1 wherein the rings (20, 22) are of the same configurations and the recesses (12, 14) are uniformly distributed about the axis (10), and the elements (16, 18) comprise radially directed means (30) for co-acting with the operating means (24).

17. A game of patience according to claim 16 wherein the radially directed means (30) comprise projections which co-act with the operating means (24) by way of the coupling members (28) which are rotatable about a plurality of corresponding radial axes (32, 34, 36).

18. A game of patience according to claim 1 wherein a plurality of coupling members (28) adapted for engagement with at least one pair of the elements (16, 18) comprise a plurality of pinions (38) which co-act with a plurality of axially extending tooth racks (40) of the operating means (24).

19. A game of patience according to claim 18 wherein the tooth racks (40) having the operating means (24) are adjustable between an active operating position and an inactive operating position.

20. A game of patience according to claim 1 wherein a spring loaded pressure ring (46) having recesses (48) co-act with a plurality of engagement projections (50) of the operating means (24).

21. A game of patience according to claim 1 wherein the elements (16, 18) each have a form of a hemisphere.

22. A game of patience according to claim 1 wherein the respective pairs of elements (16, 18) define a hollow body.

23. A game of patience comprising: two rings (20, 22) forming two coaxial mutually facing recesses (12, 14) rotatable relative to one another about a common axis (10), the rings (20, 22) having two elements (16, 18) supported within the recesses (12, 14), in at least one relative position of the rings (20, 22) two of the mutually opposing recesses (12, 14) are aligned with one another and accommodate a pair of the elements (16, 18), operating means (24) for rotating the elements (16, 18) relative to one another whereby the elements (16, 18) are transferred respectively into the other ring, and the operating means (24) are adjustable along a direction of the axis (10).

24. A game of patience comprising: two rings (20, 22) forming two coaxial mutually facing recesses (12, 14) rotatable relative to one another about a common axis (10), the rings (20, 22) having two elements (16, 18) supported within the recesses (12, 14), in at least one relative position of the rings (20, 22) two of the mutually opposing recesses (12, 14) are aligned with one another and accommodate a pair of the elements (16, 18), operating means (24) for rotating the elements (16, 18) relative to one another whereby the elements (16, 18) are transferred respectively into the other ring, and the elements (16, 18) are mounting pins (52, 54) which are radially directed, facing away from one another and mounted in the rings (20, 22).

25. A game of patience according to claim 24 wherein the mounting pins (52, 54) are provided between the rings (20, 22).

* * * * *